US009973838B2

(12) United States Patent
Qian et al.

(10) Patent No.: US 9,973,838 B2
(45) **Date of Patent: *May 15, 2018**

(54) LIQUID INGRESS-REDIRECTING ACOUSTIC DEVICE RESERVOIR

(71) Applicant: Apple Inc., Cupertino, CA (US)

(72) Inventors: Phillip Qian, San Jose, CA (US); Edward Siahaan, San Francisco, CA (US); Erik L. Wang, Redwood City, CA (US); Esge B. Andersen, Campbell, CA (US)

(73) Assignee: Apple Inc., Cupertino, CA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/621,802

(22) Filed: Jun. 13, 2017

(65) Prior Publication Data

US 2017/0280219 A1 Sep. 28, 2017

Related U.S. Application Data

(63) Continuation of application No. 14/695,357, filed on Apr. 24, 2015, now Pat. No. 9,716,934.

(51) Int. Cl.
*H04R 1/00* (2006.01)
*H04R 1/08* (2006.01)

(52) U.S. Cl.
CPC ..... *H04R 1/086* (2013.01)

(58) Field of Classification Search
CPC ..... H04R 1/02; H04R 1/086
See application file for complete search history.

(56) References Cited

U.S. PATENT DOCUMENTS

| | | | | |
|---|---|---|---|---|
| 5,828,012 | A * | 10/1998 | Repolle | G10K 11/18 181/175 |
| 8,587,934 | B2 * | 11/2013 | Aihara | G03B 17/08 206/320 |
| 2002/0110254 | A1 * | 8/2002 | Pavlovic | H04R 19/04 381/355 |
| 2008/0104738 | A1 * | 5/2008 | Conley | A41D 31/02 2/82 |
| 2008/0130935 | A1 | 6/2008 | Sato et al. | |
| 2009/0211360 | A1 | 8/2009 | Rapps et al. | |
| 2010/0200456 | A1 | 8/2010 | Parkinson | |
| 2010/0247857 | A1 * | 9/2010 | Sanami | H04M 1/18 428/138 |
| 2011/0255728 | A1 * | 10/2011 | Abe | H04M 1/03 381/355 |

(Continued)

*Primary Examiner* — Tuan D Nguyen
(74) *Attorney, Agent, or Firm* — David K. Cole

(57) ABSTRACT

An acoustic device such as a microphone or speaker is positioned with and coupled to a housing to connect an acoustic port of the acoustic device with an external opening of the housing. A reservoir is connected to the external opening via a bleed channel. The bleed channel may be less resistive to liquid ingress than the acoustic port. As such, the reservoir and bleed channel may redirect liquid from the external opening away from the acoustic port. In some implementations, the reservoir and/or the bleed channel may be defined by one or more acoustically permeable barriers such as meshes that cover the acoustic port, compressible materials such as foams that form a perimeter around the acoustic port, and/or adhesive layers that couple the acoustic device, the housing, and/or one or more other components.

20 Claims, 10 Drawing Sheets

(56) References Cited

U.S. PATENT DOCUMENTS

| | | | | |
|---|---|---|---|---|
| 2014/0044297 | A1 | 2/2014 | Loeppert et al. | |
| 2015/0146905 | A1 | 5/2015 | Abe et al. | |
| 2015/0237431 | A1 | 8/2015 | Jeziorek et al. | |
| 2016/0037243 | A1* | 2/2016 | Lippert | H04R 1/086 381/166 |
| 2016/0228826 | A1 | 8/2016 | Furuuch | |
| 2016/0239047 | A1 | 8/2016 | Weber | |
| 2016/0241945 | A1* | 8/2016 | Zadesky | H04R 1/086 |
| 2017/0025785 | A1 | 1/2017 | Song et al. | |
| 2017/0030851 | A1 | 2/2017 | Kardassakis et al. | |

* cited by examiner

LIQUID INGRESS-REDIRECTING ACOUSTIC DEVICE RESERVOIR

This application is a continuation of U.S. patent application Ser. No. 14/695,357, filed Apr. 24, 2015, which is hereby incorporated by reference herein in its entirety.

TECHNICAL FIELD

This disclosure relates generally to acoustic devices such as microphones or speakers, and more specifically to a reservoir and/or bleed channel arrangement for acoustic devices that redirects liquid ingress.

BACKGROUND

Many electronic devices include acoustic devices such as microphones or speakers. For example, microphones or speakers are often included in electronic devices such as laptop or desktop computers, cellular telephones, smart phones, earphones, digital media players, wearable devices, tablet computers, mobile computers, and so on. Such acoustic devices may enable electronic devices to generate and/or detect sound.

In many cases, acoustic devices may be at least partially positioned within a housing. This housing may operate in some measure to shield the acoustic device from the environment. For example, many acoustic devices may be sensitive to damage from rain, sweat, and/or other liquids or contaminants such as dust. However, acoustic devices may still be exposed to an external environment to some degree through an opening in the housing in order for the acoustic device to be able to transmit and/or receive acoustic waves.

SUMMARY

The present disclosure details systems, apparatuses and methods related to redirection of liquid ingress in acoustic devices by using reservoirs. An acoustic device (such as a microphone or speaker) may be positioned within and possibly coupled to a housing to connect an acoustic port of the acoustic device with an external opening of the housing. A reservoir may be connected to the external opening via a bleed channel. The bleed channel may be less resistive to liquid ingress than the acoustic port such that the reservoir and bleed channel redirect liquid ingress from the external opening away from the acoustic port. This may protect the acoustic device from damage and/or hampered operation that may otherwise be caused by the liquid ingress, particularly when pressure of liquid ingress may otherwise force liquid into the acoustic port.

In various embodiments, an electronic device may include a housing defining an external opening, an acoustic device positioned within or coupled to the housing and having an acoustic port, and an assembly positioned between the housing and the acoustic device. The assembly may include an acoustically permeable barrier (which may be at least one of an acoustic membrane, a screen, or a mesh) (which may cover the acoustic port in some implementations), a reservoir, and a bleed channel defined between the acoustically permeable barrier and the housing.

In some examples, the bleed channel may connect the reservoir and the external opening and may be operable to redirect liquid away from the acoustic port into the reservoir. The bleed channel may be operable to redirect liquid away from the acoustic port into the reservoir because the acoustically permeable barrier covering the acoustic port is more resistive to liquid than the bleed channel. The electronic device may further include an adhesive layer positioned between the acoustically permeable barrier and the housing that defines the bleed channel.

In various examples, the reservoir various operable to drain into an internal volume of the electronic device.

In some examples, the electronic device may further include a compressible material positioned between the acoustically permeable barrier and the acoustic device that defines a passage between the acoustic port and the acoustically permeable barrier. Compression of the compressible material may be operable to create a greater suction in the reservoir than in the acoustic port and the greater suction pulls liquid away from the acoustic port into the reservoir.

In some embodiments, a liquid ingress-redirecting assembly may include an acoustic device coupled to a housing defining an external opening and having an acoustic port aligned with the external opening, a mesh that covers the acoustic port, a foam layer positioned adjacent to the mesh, and a reservoir defined in the mesh and the foam layer spaced apart from the acoustic port that is operable to draw liquid away from the acoustic port.

In various examples, the foam layer may form a perimeter around at least one of the reservoir or the acoustic port. The foam layer may define a single air path between the acoustic port and the external opening. The foam layer may be operable to pump liquid from the external opening into the reservoir when the foam layer is compressed. Compression of the foam layer may create a suction in the reservoir that pulls liquid into the reservoir.

In some examples, the mesh may be positioned between the acoustic device and the foam layer. The mesh may form a perimeter around the reservoir.

In various embodiments, an apparatus may include a housing defining an opening, an acoustic port of an acoustic device coupled to the housing and operable to transmit or receive acoustic waves via the opening, a seal (which may be at least one of a foam, a gel, silicone, or an o-ring) around the acoustic port positioned between the housing and the acoustic device, a reservoir, and a channel defined between the seal and the housing that provides a flow path from the opening to the reservoir.

In some examples, the reservoir may be aligned with the opening and/or the acoustic port may be covered by the housing.

In various examples, the channel may be defined by an adhesive layer positioned between the seal and the housing.

In some examples, the apparatus may be configured to resist liquid ingress into the acoustic port by redirecting the liquid ingress through the channel into the reservoir.

It is to be understood that both the foregoing general description and the following detailed description are for purposes of example and explanation and do not necessarily limit the present disclosure. The accompanying drawings, which are incorporated in and constitute a part of the specification, illustrate subject matter of the disclosure. Together, the descriptions and the drawings serve to explain the principles of the disclosure.

DETAILED DESCRIPTION

The description that follows includes sample systems, apparatuses, and methods that embody various elements of the present disclosure. However, it should be under stood that the described disclosure may be practiced in a variety of forms in addition to those described herein.

The present disclosure details systems, apparatuses and methods related to redirecting liquid ingress in acoustic devices by using one or more reservoirs. An acoustic device, such as a microphone or speaker, may be coupled to a housing to connect an acoustic port of the acoustic device with an external opening of the housing. A reservoir may be connected to the external opening via a bleed channel. The reservoir and/or the bleed channel may be defined by one or more acoustically permeable barriers such as meshes that cover the acoustic port, compressible materials such as foams that form a perimeter around the acoustic port, and/or adhesive layers that couple the acoustic device, the housing, and/or one or more other components.

The bleed channel may be less resistive to liquid ingress than the acoustic port and/or the acoustically permeable barrier so that the reservoir and bleed channel may redirect liquid entering from the external opening away from the acoustic port. This may protect the acoustic device from damage and/or hampered operation that may otherwise be caused by the liquid ingress, particularly when the pressure of the liquid ingress may otherwise force liquid into the acoustic port.

In various implementations, compressible materials such as a foam or foam layer forms a perimeter around the acoustic port and may also define the reservoir (which may also be defined by a perimeter a mesh forms around the reservoir). Compression of the compressible material around the acoustic port may create a suction in the acoustic port that operates to pull liquid into the acoustic port. However, such compression may also compress the compressible material around the reservoir. This may create a greater suction in the reservoir than in the acoustic port such that liquid is pumped away from the acoustic port into the reservoir.

In some implementations, the acoustic port may be aligned with the external opening. However, in other implementations the acoustic port may be connected to the external opening without being directly aligned such that the acoustic port is able to transmit and/or receive acoustic waves via the external opening. In some such other implementations, the reservoir may be aligned with the external opening.

Figure 1:
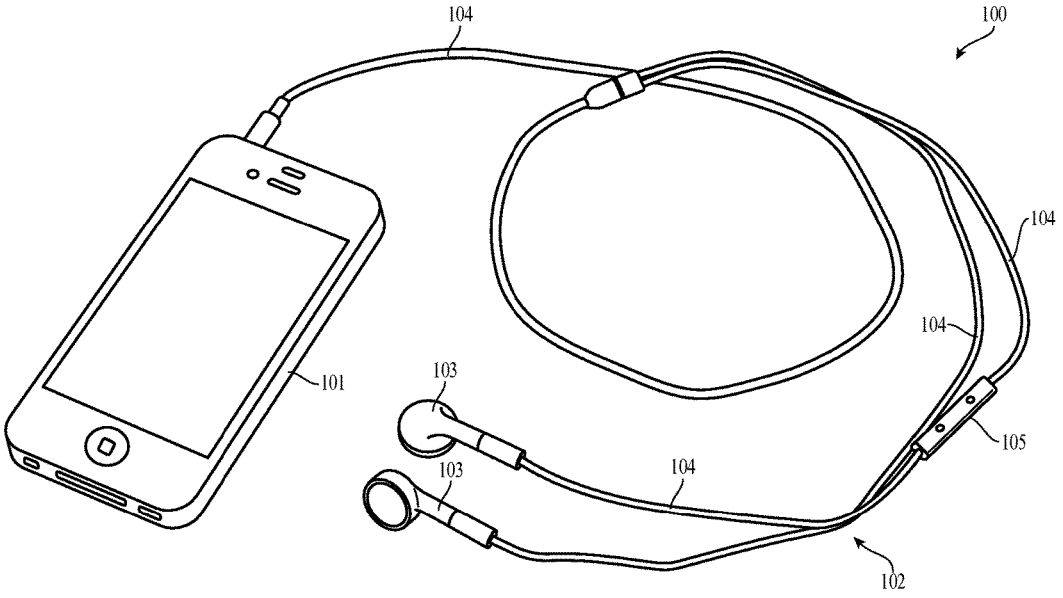
FIG. 1 is an isometric view of a system including an electronic device that includes a liquid ingress-redirecting acoustic device reservoir.
Figure 2:
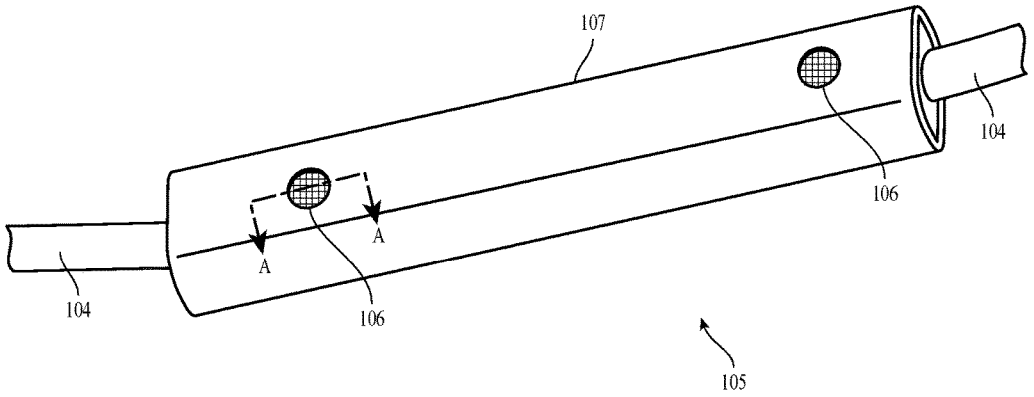
FIG. 2 is a close-up view of a portion of the electronic device of FIG. 1.

FIG. 1 is a perspective view of a system 100 including an in-line headphone controller device 105 that has a liquid ingress-redirecting acoustic device reservoir. A headphone accessory 102 that includes the in-line headphone controller device 105 and earbuds 103 coupled to a smart phone 101 via wires 104. The in-line headphone controller device 105 includes microphone and speaker functionality. A user may control the smart phone 101 by manipulating the in-line headphone controller device 105 and/or manipulating one or more input mechanisms of the smart phone 101. FIG. 2 is a close-up view of the device 105 of FIG. 1 showing the device 105 including one or more external openings 106 and one or more housings 107.

Figure 3:
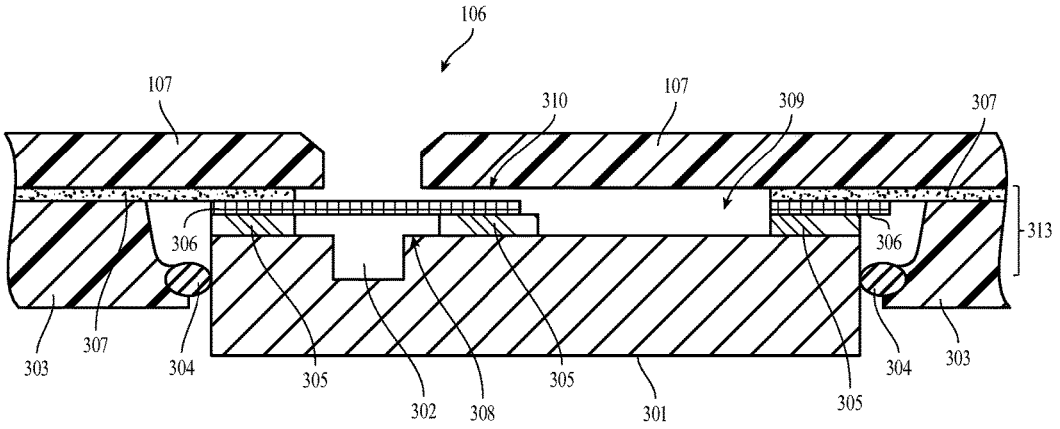
FIG. 3 is a cross-sectional view of a liquid ingress-redirecting assembly of the electronic device of FIG. 2, taken along line A-A of FIG. 2.

FIG. 3 is a cross sectional view of a liquid ingress-redirecting assembly 313 of the device 105 of FIG. 2, taken along line A-A of FIG. 2. The liquid ingress-redirecting assembly 313 may include an acoustic device 301 with an acoustic port 302 coupled to the housing 107, a layer of mesh 306 covering the acoustic port 302, a layer of foam 305 positioned adjacent to the layer of mesh 306, and a reservoir 309 defined in the mesh and foam layer that is connected to the external opening 106 by a bleed channel 310 or flow path. The acoustic device 301 may be coupled to the housing 107 so as to define the reservoir 309 and the bleed channel 310. The reservoir 309 and bleed channel 310 may redirect or draw liquid that ingresses into the external opening 106 away from the acoustic port 302.

In this example, the acoustic device 301 is coupled to the housing 107 via an internal frame 303. The internal frame 303 may be coupled to the housing 107 via a layer of adhesive 307, which may be a pressure sensitive adhesive, double sided tape, and/or any other adhesive or adhesive layer. The acoustic device 301 may be coupled to the internal frame 303 via an o-ring 304 and/or other coupling mechanism.

The acoustic device 301 may be coupled to a portion of the housing 107 that includes the external opening 106 such that the acoustic device 301 is able to transmit acoustic waves from the acoustic port 302 through the external opening 106 and/or receive acoustic waves from the external opening through the acoustic port 302. As shown, the acoustic port 302 may be aligned with the external opening 106. However, it should be understood that this is an example and in various implementations the acoustic port and the external opening may not be aligned such the acoustic port 302 is covered by the housing 107.

As shown, a sub assembly that may include the mesh 306 and the foam 305 may be positioned between a surface of the acoustic device 301 which includes the acoustic port 302 and the housing 107. The foam 305 may define a passage 308 around the acoustic port 302 between the acoustic port 302 and the mesh 306. The mesh 306 may cover the passage 308 and the acoustic port 302. The mesh 306 and/or the foam 305 may also define the reservoir 309, which may be spaced apart from the acoustic port 302. For example, as shown the mesh 306 and the foam 305 may include apertures that form perimeters around and/or otherwise define the reservoir 309.

The bleed channel 310 may connect the external opening 106 and the reservoir 309. The bleed channel 310 may be defined between the mesh 306 and the housing 107. The bleed channel 310 may also be defined by an aperture in the adhesive 307 (see for example FIG. 4).

Because the bleed channel 310 connects the external opening 106 to the reservoir 309, a flow path may be formed from the bleed channel 310 into the reservoir 309. The mesh 306 may form a barrier that allows passage of acoustic waves but resists at least some passage of contaminants such as dust or liquid into the acoustic port 302. The bleed channel 310 may be less resistive to liquid ingress than the mesh 306 covering the acoustic port 302. Due to the higher resistance of the mesh 306, liquid that ingresses into the external opening 106 may be redirected away from the acoustic port 302 into the reservoir 309.

This may prevent liquid buildup around the acoustic port 302, improving operation of the acoustic device 301 even when exposed to liquids such as sweat from the hand of a user, rain from the environment, and/or other liquids. This may also prevent liquid ingress through the external opening caused by pressure forcing the liquid through the mesh 306. In some cases, the pressure of the liquid ingress may be reduced or relieved by redirecting the liquid into the reservoir.

In some cases, the housing 107 may be flexible enough to allow for local compression or deformation of the foam 305, such as when force is applied to the device 105 by the hand of a user. Compression of the foam 305 around the passage 308 may actually create a suction that acts as a pump to pull liquid toward the acoustic port 302. However, because such compression would also compress the foam 305 surrounding the reservoir 309, the reservoir 309 would also create a suction that would function to pump the liquid toward and/or pull the liquid into the reservoir 309. Because of the lower resistance of the flow path through the bleed channel 310 into the reservoir 309, the suction of the reservoir 309 would thus be greater than the suction in the passage 308. Therefore, the reservoir 309 and bleed channel 310 may still operate to redirect liquid away from the acoustic port 302 even under compression of the foam 305.

The acoustic device 301 may acoustically perform optimally when a seal is present around the acoustic port 302 between the acoustic device 301 and the external opening 106 such that there is a single air path between the acoustic port 302 and the external opening 106. The foam 305 around the passage 308 may be compressed by the mesh 306 to seal around the acoustic port 302 in this way. The bleed channel 310 defined between the housing 107 and the mesh 306 may cause the area immediately around the acoustic port 302 to not be entirely sealed between the acoustic device 301 and the external opening 106. However, the portion of the foam 305 that defines the reservoir 309 and couples to the housing 107 via the mesh 306 and the adhesive 307 may cause the reservoir 309 to function as a Helmholtz resonator such that acoustic performance is minimally impacted. This configuration may also cause there to be a single air path between the acoustic port 302 and the external opening 106.

The acoustic device 301 may be any kind of acoustic device. Examples of such acoustic devices include microphones, speakers, microelectromechanical systems (MEMS) microphones, MEMS speakers, and so on.

As illustrated, the mesh 306 is coupled to the housing 107 via the adhesive 307. However, it should be understood that this is an example. Although not shown, the mesh 306 may be coupled to the foam 305, and/or the foam 305 to the acoustic device 301, via one or more adhesives and/or other coupling mechanisms as well.

Further, although the mesh 306 is described as a mesh, it should be understood that this is an example. In various implementations, the mesh 306 may be any kind of acoustically permeable barrier. Examples of such acoustically permeable barriers include an acoustic membrane (such as stretched polytetrafluoroethylene), a screen, a mesh, and so on. An acoustically permeable membrane may allow and/or minimally hinder passage of acoustic waves while resisting the passage of contaminants such as dust, liquids, dirt, and so on.

Similarly, although the foam 305 is described as foam, it should be understood that this is an example. In various implementations, the foam 305 may be any kind of compressible material such as a gel, silicone, an elastomer, an o-ring and/or other kind of seal, and so on.

Moreover, although a particular stack up of mesh 306 and foam 305 is illustrated and described, it should be understood that this is an example. In various implementations, the mesh 306 may be positioned between the foam 305 and the acoustic device without departing from the scope of the present disclosure. In other implementations, the mesh 306 and/or various other components may be omitted without departing from the scope of the present disclosure.

Although the device 105 is illustrated and described above as in-line headphone controller, it is understood that in various implementations the device 105 may be any kind of electronic or other device that has a liquid ingress-redirecting acoustic device reservoir (and/or has an acoustic modules including such reservoirs positioned within a housing). Examples of such devices may include laptop or desktop computers, cellular telephones, smart phones, earphones, digital media players, wearable devices, tablet computers, mobile computers, other electronic devices, and so on.

Figure 4:
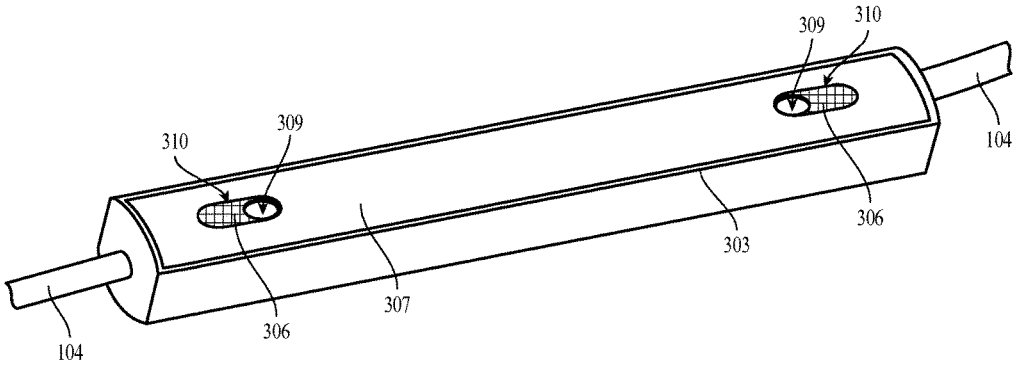
FIG. 4 illustrates the electronic device of FIG. 2 with the housing removed.

FIG. 4 illustrates the device 105 of FIG. 2 with the housing 107 removed. As shown, the adhesive 307 is positioned on the internal frame 303. As also shown, the adhesive 307 defines the bleed channel 310 around the mesh 306 and the reservoir 309. Further illustrated is the aperture defined in the mesh 306 that at least partially defines the reservoir 309.

Figure 5A:
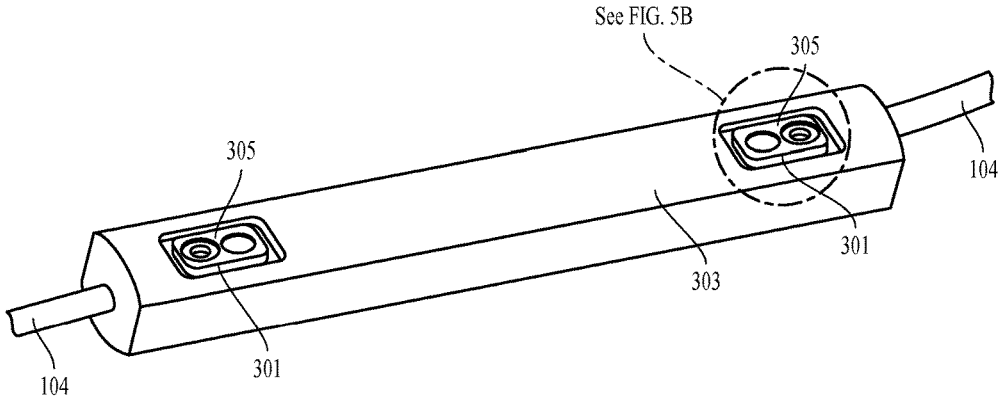
FIG. 5A illustrates the electronic device of FIG. 4 with the adhesive and the mesh removed.
Figure 5B:
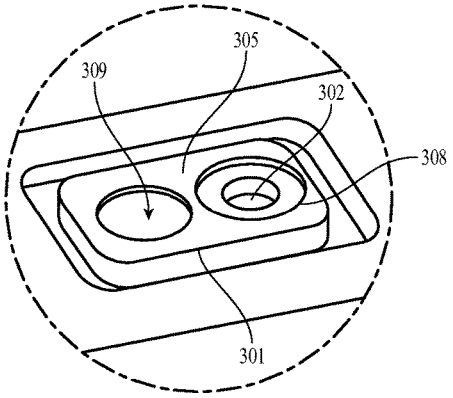
FIG. 5B is a detail view of the indicated portion of FIG. 5A.

FIG. 5A illustrates the device 105 of FIG. 4 with the adhesive 307 and the mesh 306 removed. FIG. 5B is a detail view of the indicated portion of FIG. 5A. As shown in FIG. 5B, an aperture (or depression) in the foam 305 at least partially defines the reservoir 309. As also shown, the foam 305 defines the passage 308 around the acoustic port 302 of the acoustic device 301.

Figure 6:
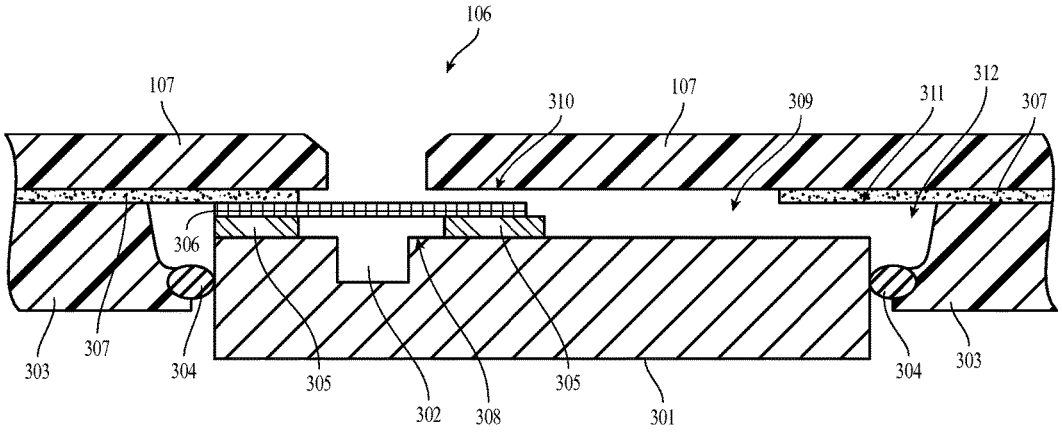
FIGS. 6-9 illustrate cross-sectional views of liquid ingress-redirecting assemblies in accordance with further embodiments of the disclosure.

Returning to FIG. 3, although the foam 305 and the mesh 306 are illustrated and described as forming a perimeter around the reservoir 309, it should be understood that this is an example. In various implementations, the perimeter of the reservoir may not be defined by both the foam 305 and the mesh 306. For example, FIG. 6 illustrates a liquid ingress-redirecting assembly in accordance with a further embodiment of the disclosure where the reservoir 309 may be connected to a drain 311 defined between the housing 107 and the acoustic device 301. This drain 311 may be operable to drain the reservoir 309 into an internal volume 312 of the device 105.

Figure 7:
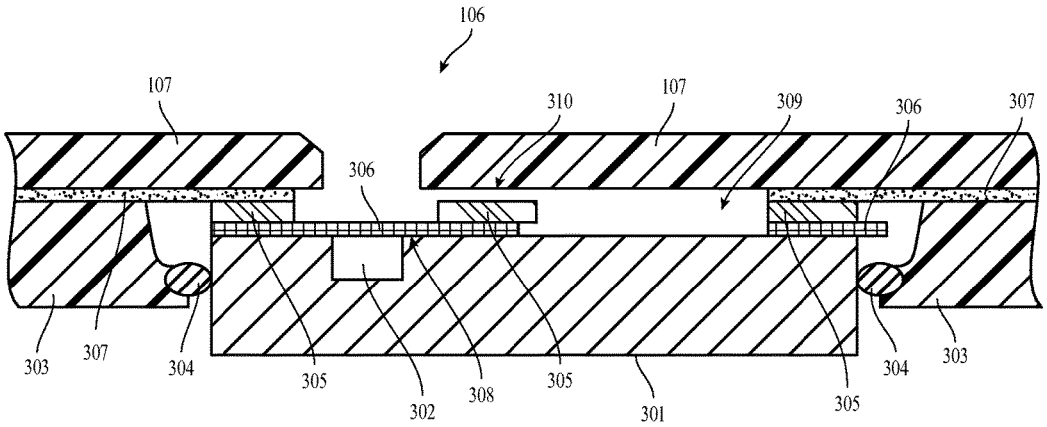

Returning again to FIG. 3, although the foam 305 and the mesh 306 are illustrated such that the foam 305 is positioned between the mesh 306 and the acoustic device 301, it should be understood that this is an example. In various implementations, the foam 305 and the mesh 306 may be otherwise configured. For example, FIG. 7 illustrates a liquid ingress-redirecting assembly in accordance with a further embodiment of the disclosure where the mesh 306 is positioned between the foam 305 and the acoustic device 301.

Figure 8:
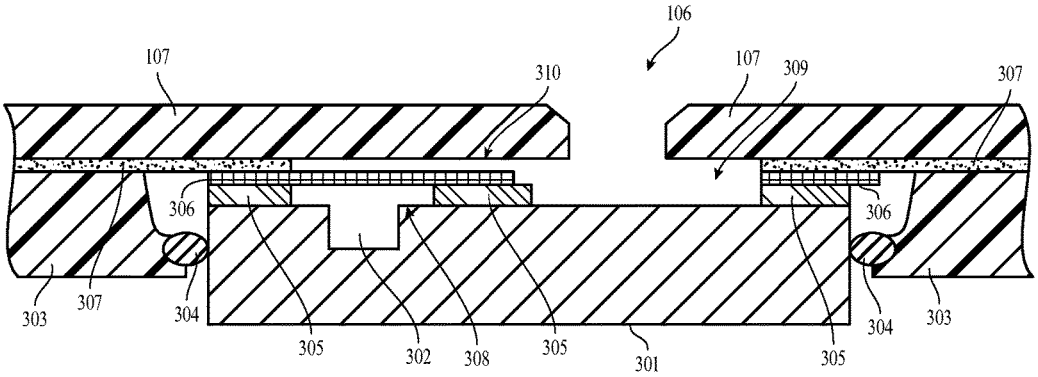

Returning to FIG. 3, although the acoustic port 302 is illustrated and described as aligned with the external opening 106, it should be understood that this is an example. In various implementations, the acoustic port 302 may be able to transmit and/or receive acoustic waves via the external opening 106 but may not be directly aligned with the external opening 106. For example, FIG. 8 illustrates a liquid ingress-redirecting assembly in accordance with a further embodiment of the disclosure. Similar to the configuration shown in FIG. 3, this liquid ingress-redirecting assembly may include the housing 107, the external opening 106, the adhesive 307, the internal frame 303, the o-ring 304, the acoustic device 301, the acoustic port 302, the passage 308, the reservoir 309, the bleed channel 310, the foam 305, and the mesh 306. However, as contrasted with the configuration shown in FIG. 3, in this liquid ingress-redirecting assembly the housing 107 covers the acoustic port 302 and the external opening 106 is instead aligned with a portion of the reservoir 309. Such a configuration may not perform acoustically as optimally, but may result in the flow path between the external opening 106 and the reservoir even less resistive than the flow path between the external opening 106 and the acoustic port 302. This may further increase the ability of the reservoir 309 to redirect liquid away from the acoustic port.

Figure 9:
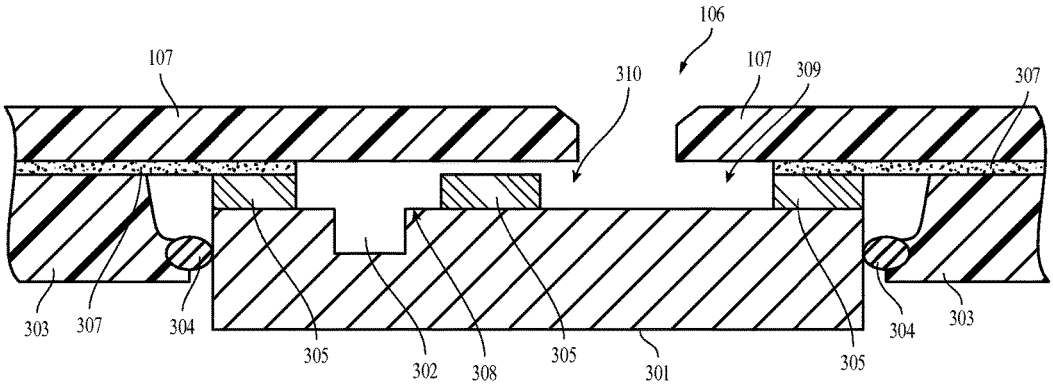

In some implementations, a configuration such as shown in FIG. 8 may result in the flow path between the external opening 106 and the reservoir so much less resistive than the flow path between the external opening 106 and the acoustic port 302 that the mesh 306 is unneeded. For example, FIG. 9 illustrates a liquid ingress-redirecting assembly in accordance with a further embodiment of the disclosure. Similar to the configuration shown in FIG. 8, this liquid ingress-redirecting assembly may include the housing 107, the external opening 106, the adhesive 307, the internal frame 303, the o-ring 304, the acoustic device 301, the acoustic port 302, the passage 308, the reservoir 309, the bleed channel 310, and the foam 305. However, as contrasted with the configuration shown in FIG. 8, in this liquid ingress-redirecting assembly, the mesh 306 is not utilized.

In some cases, one or more of the liquid ingress-redirecting assemblies of FIGS. 6-9 may not acoustically function as optimally as that shown in FIG. 3. However, in some instances the acoustic impact of such a configuration may be small enough to be acceptable.

Figure 10:
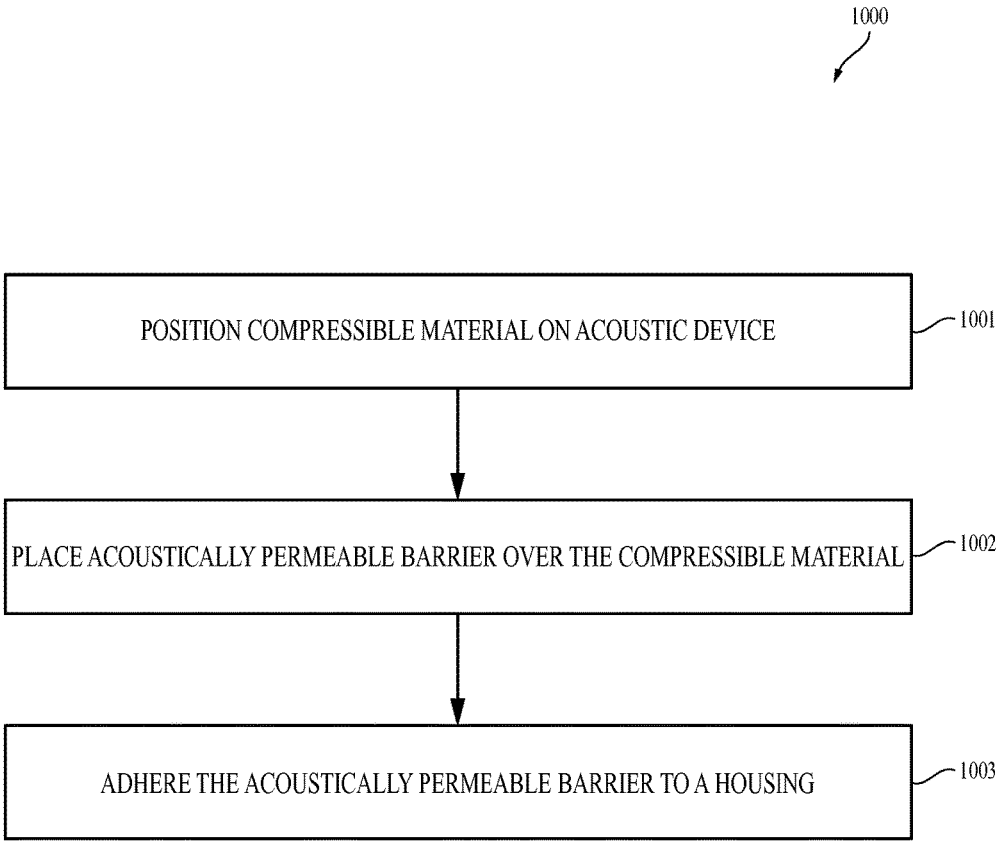
FIG. 10 is a flow diagram illustrating an example method for forming a liquid ingress-redirecting assembly. This method may form one or more of the liquid ingress-redirecting assemblies of FIGS. 3 and 6-9.

FIG. 10 is a method diagram illustrating an example method 1000 for forming a liquid ingress-redirecting assembly. This method may form one or more of the liquid ingress-redirecting assemblies of FIGS. 3 and 6-9.

At block 1001, compressible material may be positioned on an acoustic device. The compressible material may be positioned on the acoustic device such that the compressible material surrounds a perimeter of an acoustic port of the acoustic device. The compressible material may also be positioned on the acoustic device such that the compressible material surrounds a perimeter of a reservoir area.

At block 1002, an acoustically permeable barrier may be placed over the compressible material. The acoustically permeable barrier may be placed to cover the acoustic port. The acoustically permeable barrier may also be placed to form a perimeter around the reservoir area.

At block 1003, the acoustically permeable barrier may be adhered to a housing. The acoustically permeable barrier may be adhered to the housing such that the acoustic port of the acoustic device is aligned with an external opening in the housing.

Although the example method 1000 is illustrated and described as including particular operations performed in a particular order, it should be understood that this is an example. In various implementations, various orders of the same, similar, and/or different operations may be performed without departing from the scope of the present disclosure.

For example, the method 1000 is illustrated and described as positioning the compressible material on the acoustic device, placing the acoustically permeable barrier on the compressible material, and adhering the acoustically permeable barrier to the housing. However, in some implementations the acoustically permeable barrier may be omitted without departing from the scope of the present disclosure. In other implementations, the positions of the compressible material and the acoustically permeable barrier may be reversed. In still other implementations, the compressible material may be adhered to the acoustic device and/or the acoustically permeable barrier. Various configurations are possible and contemplated.

As described above and illustrated in the accompanying figures, the present disclosure details systems, apparatuses and methods related to redirection of liquid in acoustic devices through using reservoirs. An acoustic device, such as a microphone or speaker, may be couple to a housing to connect an acoustic port of the acoustic device with an external opening of the housing. A reservoir may be connected to the external opening via a bleed channel. The reservoir and/or the bleed channel may be defined by one or more acoustically permeable barriers such as meshes that cover the acoustic port, compressible materials such as foams that form a perimeter around the acoustic port, and/or adhesive layers that couple the acoustic device, the housing, and/or one or more other components. The bleed channel may be less resistive to liquid ingress than the acoustic port and/or a acoustically permeable barrier such that the reservoir and bleed channel redirect liquid ingress from the external opening away from the acoustic port. This may protect the acoustic device from damage and/or hampered operation that may otherwise be caused by the liquid ingression, particularly when a liquid pressure may otherwise force liquid into the acoustic port.

In the present disclosure, it should be understood that the specific order or hierarchy of steps in the methods disclosed are examples of sample approaches. In other embodiments, the specific order or hierarchy of steps in the method can be rearranged while remaining within the disclosed subject matter. Any accompanying method claims present elements of the various steps in a sample order, and are not necessarily meant to be limited to the specific order or hierarchy presented.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context or particular embodiments. Functionality may be separated or combined in blocks differently in various embodiments of the disclosure or described with different terminology. These and other variations, modifications, additions, and improvements may fall within the scope of the disclosure as defined in the claims that follow.

What is claimed is:

1. An electronic device, comprising:
a housing having an opening;
an acoustic device aligned with the opening;
a reservoir interposed between the acoustic device and the housing;
a bleed channel configured to guide liquid into the reservoir; and
a layer of mesh interposed between the acoustic device and the housing, wherein the layer of mesh has first and second portions, wherein the first portion is attached to the housing with adhesive, and wherein the bleed channel is located between the second portion and the housing.

2. The electronic device defined in claim 1 wherein the acoustic device comprises an acoustic port.

3. The electronic device defined in claim 2 wherein the first and second portions of the layer of mesh are located on either side of the acoustic port.

4. The electronic device defined in claim 2 wherein the acoustic port is aligned with the opening.

5. The electronic device defined in claim 2 wherein the reservoir is aligned with the opening.

6. The electronic device defined in claim 2 further comprising a foam layer surrounding the acoustic port.

7. The electronic device defined in claim 6 wherein the foam layer is interposed between the acoustic device and the layer of mesh.

8. The electronic device defined in claim 6 wherein the layer of mesh is interposed between the acoustic device and the foam layer.

9. The electronic device defined in claim 1 further comprising an internal frame attached to the housing with adhesive, wherein the internal frame is sealed to the acoustic device with an o-ring.

10. The electronic device defined in claim 9 further comprising an internal volume defined between the internal frame and the acoustic device, wherein the internal volume is configured to hold additional liquid.

11. An electronic device, comprising:
a housing having an opening;
an electronic component aligned with the opening;
a reservoir configured to hold liquid that enters the opening;
a mesh layer covering a portion of the electronic component; and
a foam layer that overlaps the mesh layer, wherein the mesh layer and the foam layer form a perimeter around the reservoir.

12. The electronic device defined in claim 11 wherein the foam layer is interposed between the electronic component and the mesh layer.

13. The electronic device defined in claim 11 wherein the mesh layer is interposed between the electronic component and the foam layer.

14. The electronic device defined in claim 11 wherein the reservoir is aligned with the opening of the housing.

15. The electronic device defined in claim 11 wherein the electronic component comprises an acoustic device.

16. An electronic device, comprising:
a housing having a hole;
an acoustic device having an acoustic port;
a seal between the acoustic device and the housing, wherein the seal comprises first and second openings, and wherein the first opening is aligned with the acoustic port;
a reservoir formed in the second opening; and
a channel defined between the seal and the housing, wherein the channel is configured to guide liquid from the hole to the reservoir.

17. The electronic device defined in claim 16 wherein the first opening is aligned with the hole.

18. The electronic device defined in claim 16 wherein the second opening is aligned with the hole.

19. The electronic device defined in claim 16 wherein the seal comprises a foam layer and an adhesive layer.

20. The electronic device defined in claim 19 wherein the seal further comprises a mesh layer.

* * * * *